US006887348B2

(12) United States Patent
Hermans et al.

(10) Patent No.: US 6,887,348 B2
(45) Date of Patent: May 3, 2005

(54) ROLLED SINGLE PLY TISSUE PRODUCT HAVING HIGH BULK, SOFTNESS, AND FIRMNESS

(75) Inventors: Michael Alan Hermans, Neenah, WI (US); Clayton C. Troxell, Appleton, WI (US); Tammy L. Baum, Neenah, WI (US); Sharon S. Chang, Appleton, WI (US); James Leo Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 159 days.

(21) Appl. No.: 10/305,784

(22) Filed: Nov. 27, 2002

(65) Prior Publication Data

US 2004/0101704 A1 May 27, 2004

(51) Int. Cl.[7] ..... D21F 11/14

(52) U.S. Cl. ..... 162/109; 162/117; 162/118; 162/205; 428/153; 428/154; 428/141

(58) Field of Search ..... 162/109, 111–113, 162/117–118, 123–125, 127–129, 204–207; 428/153–154, 141, 535, 537.5

(56) References Cited

U.S. PATENT DOCUMENTS

| | | | |
|---|---|---|---|
| 3,585,104 A | 6/1971 | Kleinert | |
| 3,879,257 A | 4/1975 | Gentile et al. | |
| 3,995,354 A | 12/1976 | Groome | |
| 4,158,594 A | 6/1979 | Becker et al. | |
| 4,166,001 A | 8/1979 | Dunning et al. | |
| 4,196,045 A | 4/1980 | Ogden | |
| 4,208,459 A | 6/1980 | Becker et al. | |
| 4,300,981 A | 11/1981 | Carstens | |
| 4,594,130 A | 6/1986 | Chang et al. | |
| 4,793,898 A | 12/1988 | Laamanen et al. | |
| 5,048,589 A | 9/1991 | Cook et al. | |
| 5,059,282 A | 10/1991 | Ampulski et al. | |
| 5,129,988 A | 7/1992 | Farrington, Jr. | |
| 5,164,045 A | 11/1992 | Awofeso et al. | |
| 5,399,412 A | 3/1995 | Sudall et al. | |
| 5,409,572 A | 4/1995 | Kershaw et al. | |
| 5,429,686 A | 7/1995 | Chiu et al. | |
| 5,494,554 A | 2/1996 | Edwards et al. | |
| 5,562,805 A | 10/1996 | Kamps et al. | |
| 5,595,628 A | 1/1997 | Gordon et al. | |
| 5,607,551 A | 3/1997 | Farrington, Jr. et al. | |
| 5,624,532 A | 4/1997 | Trokhan et al. | |
| 5,656,132 A | 8/1997 | Farrington, Jr. et al. | |
| 5,672,248 A | 9/1997 | Wendt et al. | |
| 5,695,607 A | 12/1997 | Oriaran et al. | |
| 5,702,571 A | 12/1997 | Kamps et al. | |
| 5,743,999 A | 4/1998 | Kamps et al. | |
| 5,772,845 A | 6/1998 | Farrington, Jr. et al. | |
| 5,846,380 A | 12/1998 | Van Phan et al. | |
| 5,851,629 A | 12/1998 | Oriaran et al. | |
| 5,882,479 A | 3/1999 | Oriaran et al. | |
| 5,904,812 A | 5/1999 | Salman et al. | |
| 5,932,068 A | 8/1999 | Farrington, Jr. et al. | |
| 5,958,185 A | 9/1999 | Vinson et al. | |
| 5,980,691 A | 11/1999 | Weisman et al. | |
| 6,030,496 A | 2/2000 | Baggot et al. | |
| 6,033,523 A | 3/2000 | Dwiggins et al. | |
| 6,033,761 A | 3/2000 | Dwiggins et al. | |
| 6,051,104 A | 4/2000 | Oriaran et al. | |
| 6,068,731 A | 5/2000 | Dwiggins et al. | |
| 6,077,390 A | 6/2000 | Salman et al. | |
| 6,077,590 A | 6/2000 | Archer et al. | |
| 6,103,063 A | 8/2000 | Oriaran et al. | |
| 6,113,740 A | 9/2000 | Oriaran et al. | |
| 6,143,131 A | 11/2000 | Dwiggins et al. | |
| 6,153,053 A | 11/2000 | Harper et al. | |
| 6,162,327 A | 12/2000 | Batra et al. | |
| 6,165,319 A | 12/2000 | Heath et al. | |
| 6,171,442 B1 | 1/2001 | Farrington, Jr. et al. | |
| 6,183,599 B1 | 2/2001 | Oriaran et al. | |
| 6,193,838 B1 | 2/2001 | Oriaran et al. | |
| 6,277,467 B1 | 8/2001 | Dwiggins et al. | |
| 6,280,570 B1 | 8/2001 | Harper et al. | |
| 6,287,422 B1 | 9/2001 | Harper et al. | |
| 6,299,729 B1 | 10/2001 | Heath et al. | |
| 6,328,849 B1 | 12/2001 | Dwiggins et al. | |
| 6,331,228 B1 | 12/2001 | Heath et al. | |
| 6,334,931 B1 | 1/2002 | Dwiggins et al. | |
| 6,344,111 B1 * | 2/2002 | Wilhelm | 162/117 |
| 6,368,454 B1 | 4/2002 | Dwiggins et al. | |
| 6,372,087 B1 | 4/2002 | Harper et al. | |
| 6,423,180 B1 | 7/2002 | Behnke et al. | |
| 6,436,234 B1 | 8/2002 | Chen et al. | |
| 6,440,268 B1 | 8/2002 | Baggot et al. | |
| 6,458,450 B1 | 10/2002 | Steinhardt et al. | |

(Continued)

FOREIGN PATENT DOCUMENTS

| | | |
|---|---|---|
| EP | 0347154 B1 | 1/1996 |
| EP | 0772716 B1 | 3/2002 |
| EP | 1318235 A2 A3 | 6/2003 |
| FR | 2588293 A1 | 4/1987 |
| GB | 2304123 A | 3/1997 |
| WO | WO 9963158 A1 | 12/1999 |
| WO | WO 0008253 A1 | 2/2000 |
| WO | WO 0185438 A2 | 11/2001 |
| WO | WO 0240774 A2 A3 | 5/2002 |

OTHER PUBLICATIONS

PCT Search Report for PCT/US03/38066, Oct. 20, 2004.

*Primary Examiner*—JoséA. Fortuna
(74) *Attorney, Agent, or Firm*—Dority & Manning, P.A.

(57) ABSTRACT

Spirally wound paper products are disclosed having desirable roll firmness characteristics and softness properties. The rolled products can be made from a single ply tissue web formed according to various processes. Once formed, the tissue web is subjected to a shear-calendering device that increases the fuzz-on-edge properties of the web and preserves the bulk of the web when wound.

35 Claims, 6 Drawing Sheets

U.S. PATENT DOCUMENTS 6,468,392 B1 * 10/2002 Oriarian et al. ..... 162/109
6,547,926 B1 * 4/2003 Drew et al. ..... 162/113
6,585,855 B1 * 7/2003 Drew et al. ..... 162/109
6,649,024 B1 * 11/2003 Oriarian et al. ..... 162/109
6,676,807 B1 * 1/2004 Hada et al. ..... 162/205
6,712,930 B1 * 3/2004 Koivukunnas ..... 162/117
6,716,308 B1 * 4/2004 Baggot et al. ..... 162/109
6,746,570 B1 * 6/2004 Burazin et al. ..... 162/109
2001/0008179 A1 * 7/2001 Oriarian et al. ..... 162/109
2001/0042606 A1 11/2001 Harper et al.
2002/0112830 A1 * 8/2002 Bakken et al. ..... 162/123
2003/0000664 A1 * 1/2003 Drew et al. ..... 162/109
2003/0041989 A1 * 3/2003 Oriarian et al. ..... 162/184
2003/0106657 A1 6/2003 Baggot
2004/0050516 A1 * 3/2004 Koivukunnas ..... 162/193
2004/0101704 A1 * 5/2004 Hermans et al. ..... 428/535
2004/0140076 A1 * 7/2004 Hermans et al. ..... 162/205

* cited by examiner

ROLLED SINGLE PLY TISSUE PRODUCT HAVING HIGH BULK, SOFTNESS, AND FIRMNESS

BACKGROUND OF THE INVENTION

In the manufacture of tissue products such as bath tissue, a wide variety of product characteristics must be given attention in order to provide a final product with the appropriate blend of attributes suitable for the product's intended purposes. Improving the softness of tissues is a continuing objective in tissue manufacture, especially for premium products. Softness, however, is a perceived property of tissues comprising many factors including thickness, smoothness, and fuzziness.

To date, in many applications two-ply tissues generally have achieved improved softness over one-ply tissues. However, in terms of manufacturing economy, multiple-ply products are typically more expensive to produce than single-ply products. Thus, a need exists for a single-ply tissue product with high bulk and softness while retaining smoothness and strength.

Traditionally, tissue products have been made using a wet-pressing process in which a significant amount of water is removed from a wet-laid web by pressing the web prior to final drying. In one embodiment, for instance, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping generally improves the softness of the web, albeit at the expense of a loss in strength.

Recently, throughdrying has increased in popularity as a means of drying tissue webs. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until it is at least almost completely dry. The resulting dried web is softer and bulkier than a wet-pressed sheet because fewer papermaking bonds are formed and because the web is less dense. Squeezing water from the wet web is eliminated, although subsequent transfer of the web to a Yankee dryer for creping is still often used to final dry and/or soften the resulting tissue.

Even more recently, significant advances have been made in high bulk sheets as disclosed in U.S. Pat. Nos. 5,607,551; 5,772,845; 5,656,132; 5,932,068; and 6,171,442, which are all incorporated herein by reference. These patents disclose soft throughdried tissues made without the use of a Yankee dryer. The typical Yankee functions of building machine direction and cross-machine direction stretch are replaced by a wet-end rush transfer and the throughdrying fabric design, respectively.

When the single ply tissue products, however, are formed into a rolled product, the base sheets tend to lose a noticeable amount of bulk due to the compressive forces that are exerted on the base web during winding and converting. As such, a need currently exists for a process for producing a single ply tissue product that has both softness and bulk when spirally wound into a roll. More particularly, a need exists for a spirally wound product that can maintain a significant amount of roll bulk and sheet softness even when the product is wound under tension to produce a roll having consumer desired firmness.

Definitions

A tissue product as described in this invention is meant to include paper products made from base webs such as bath tissues, facial tissues, paper towels, industrial wipers, foodservice wipers, napkins, medical pads, and other similar products.

Roll Bulk is the volume of paper divided by its mass on the wound roll. Roll Bulk is calculated by multiplying pi (3.142) by the quantity obtained by calculating the difference of the roll diameter squared in cm squared ($cm^2$) and the outer core diameter squared in cm squared ($cm^2$) divided by 4 multiplied by the sheet length in cm multiplied by the sheet count multiplied by the bone dry Basis Weight of the sheet in grams (g) divided by cm squared ($cm^2$).

Roll Bulk in cc/g=3.142×(Roll Diameter squared in $cm^2$−outer Core Diameter squared in $cm^2$)/(4×Sheet length in cm×g/$cm^2$) or Roll Bulk in cc/g=0.785×(Roll Diameter squared in $cm^2$−outer Core Diameter squared in $cm^2$)/(Sheet length in $cm^2$×g/$cm^2$).

For various rolled products of this invention, the bulk of the sheet on the roll can be about 11.5 cubic centimeters per gram or greater, preferably about 12 cubic centimeters per gram or greater, more preferably about 13 centimeters per gram or greater, and even more preferably about 14 centimeters per gram or greater.

Geometric mean tensile strength (GMT) is the square root of the product of the machine direction tensile strength and the cross-machine direction tensile strength of the web. Geometric tensile strengths are measured using a MTS Synergy tensile tester using a 3 inches sample width, a jaw span of 2 inches, and a crosshead speed of 10 inches per minute after maintaining the sample under TAPPI conditions for 4 hours before testing. A 50 Newton maximum load cell is utilized in the tensile test instrument.

The Kershaw Test is a test used for determining roll firmness. The Kershaw Test is described in detail in U.S. Pat. No. 6,077,590 to Archer, et al., which is incorporated herein by reference. FIG. 4 illustrates the apparatus used for determining roll firmness. The apparatus is available from Kershaw Instrumentation, Inc., Swedesboro, N.J., and is known as a Model RDT-2002 Roll Density Tester. Shown is a towel or bath tissue roll 200 being measured, which is supported on a spindle 202. When the test begins a traverse table 204 begins to move toward the roll. Mounted to the traverse table is a sensing probe 206. The motion of the traverse table causes the sensing probe to make contact with the towel or bath tissue roll. The instant the sensing probe contacts the roll, the force exerted on the load cell will exceed the low set point of 6 grams and the displacement display will be zeroed and begin indicating the penetration of the probe. When the force exerted on the sensing probe exceeds the high set point of 687 grams, the value is recorded. After the value is recorded, the traverse table will stop and return to the starting position. The displacement display indicates the displacement/penetration in millimeters. The tester will record this reading. Next the tester will rotate the tissue or towel roll 90 degrees on the spindle and repeat the test. The roll firmness value is the average of the two readings. The test needs to be performed in a controlled environment of 73.4±1.8 degrees F. and 50±2% relative humidity. The rolls to be tested need to be introduced to this environment at least 4 hours before testing.

The Fuzz-On-Edge Test is an image analysis test that determines softness. The image analysis data are taken from two glass plates made into one fixture. Each plate has a sample folded over the edge with the sample folded in the CD direction and placed over the glass plate. The edge is beveled to 1/16" thickness.

Referring to FIG. 5, one embodiment of a fixture that can be used in conducting the fuzz-on-edge test is shown. As illustrated, the fixture includes a first glass plate 300 and a second glass plate 302. Each of the glass plates have a thickness of 1/4 inch. Further, glass plate 300 includes a beveled edge 304 and glass plate 302 includes a beveled edge 306. Each beveled edge has a thickness of 1/16 inch. In this embodiment, the glass plates are maintained in position by a pair of U-shaped brackets 308 and 310. Brackets 308 and 310 can be made from, for instance, 3/4 inch finished plywood.

During testing, samples are placed over the beveled edges 304 and 306. Multiple images of the folded edges are then taken along the edge as shown at 312. Thirty (30) fields of view are examined on each folded edge to give a total of sixty (60) fields of view. Each view has "PR/EL" measured before and after removal of protruding fibers. "PR/EL" is perimeter per edge-length examined in each field-of-view. FIG. 6 illustrates the measurement taken. As shown, "PR" is the perimeter around the protruding fibers while "EL" is the length of the measured sample. The PR/EL valves are averaged and assembled into a histogram as an output page. This analysis is completed and the data is obtained using the QUANTIMET 970 Image Analysis System obtained from Leica Corp. of Deerfield, Ill. The QUIPS routine for performing this work, FUZZ10, is as follows:

```
Cambridge Instruments QUANTIMET 970 QUIPS/MX: VO8.02 USER:
ROUTINE: FUZZIO DATE: 8-MAY-81          RUN: 0 SPECIMEN:
    NAME =   FUZZB
    DOES =   PR/EL ON TISSUES; GETS HISTOGRAM
    AUTH =   B. E. KRESSNER
    DATE =   10 DEC 97
    COND =   MACROVIEWER; DCI 12×12;
             FOLLIES PINK FILTER; 3×3
             MASK 60 MM MICRO-NIKKO, F/4;
             20 MM EXTENSION TUBES;
             2 PLATE (GLASS) FIXTURE MICRO-NIKKOR
             AT FULL EXTENSION FOR MAX MAG!
             ROTATE CAM 90 deg SO THAT IMAGE ON
             RIGHT SIDE!
             ALLOWS TYPICAL PHOTO
    Enter specimen identity
    Scanner (No. 1 Chalnicon LV= 0.00 SENS= 2.36 PAUSE)
    Load Shading Corrector (pattern - FUZZ7)
    Calibrate User Specified (Cal Value - 9.709 microns per pixel)
    SUBRTN STANDARD
    TOTPREL: = 0.
    TOTFIELDS: = 0.
    PHOTO: = 0.
    MEAN: = 0.
    If PHOTO = 1, then
    Pause Message
    WANT TYPICAL PHOTO (1 = YES; 0 = NO)?
    Input PHOTO
    Endif
    If PHOTO = 1, then
    Pause Message
    INPUT MEAN VALUE FOR PR/EL
    Input MEAN
    Endif
    For SAMPLE = 1 to 2
    If SAMPLE = 1, then
    STAGEX: = 36,000.
    STAGEY: = 144,000.
    Stage Move (STAGEX, STAGEY)
    Pause Message
    please position fixture
```

-continued

```
    Pause
    STAGEX: = 120,000.
    STAGEY: = 144,000.
    Stage Move (STAGEX, STAGEY)
    Pause Message
    please focus
    Detect 2D (Darker than 54, Delin PAUSE)
    STAGEX: = 36,000.
    STAGEY: = 144,000.
    Endif
    If SAMPLE = 2, then
    STAGEX: = 120,000.
    STAGEY: = 44,000.
    Stage Move (STAGEX, STAGEY)
    Pause Message
    please focus
    Detect 2D (Darker than 54, Delin)
    STAGEX: = 36,000.
    STAGEY: = 44,000.
    Endif
    Stage Move (STAGEX, STAGEY)
    Stage Scan      (                X              Y
          scan origin              STAGEX         STAGEY
          field size               6,410.0        78,000.0
          no of fields             30             1)
    For FIELD
    If TOTFIELDS = 30, then
    Scanner (No. 1 Chalnicon AUTO-SENSITIVITY LV= 0.01)
    Endif
    Live Frame is Standard Image Frame
    Image Frame is Rectangle (X: 26, Y: 37, W: 823, H: 627)
    Scanner (No. 1 Chalnicon AUTO-SENSITIVITY LV= 0.01)
    Image Frame is Rectangle (X: 48, Y: 37, W: 803, H: 627)
    Detect 2D (Darker than 54, Delin)
    Amend (OPEN by 0)
    Measure field - Parameters into array FIELD
    BEFORPERI: = FIELD PERIMETER
    Amend (OPEN by 10)
    Measure field - Parameters into array FIELD
    AFTPERIM: = FIELD PERIMETER
    PROVEREL: = ((BEFORPERI – AFTPERIM) /
    (I.FRAME.H * CAL.CONST))
    TOTPREL: = TOTPREL + PROVEREL
    TOTFIELDS: = TOTFIELDS + 1.
    If PHOTO = 1, then
    If PROVEREL > (0.95000 * MEAN) then
    If PROVEREL < (1.0500 * MEAN) then
    Scanner (No. 1 Chalnicon AUTO-SENSITIVITY LV=
    0.01 PAUSE)
    Detect 2D (Darker than 53 and Lighter than 10,
    Delin PAUSE)
    Endif
    Endif
    Endif
    Distribute COUNT vs PROVEREL (Units MM/MM)
      into GRAPH from 0.00 to 5.00 into 20 bins, differential
    Stage Step
    Next FIELD
    Next
    Print " "
    Print "AVE PR-OVER-EL (UM/UM) =", TOTPREL /
    TOTFIELDS
    Print " "
    Print "TOTAL NUMBER OF FIELDS =", TOTFIELDS
    Print " "
    Print "FIELD HEIGHT (MM) = ", I.FRAME.H *
    CAL.CONST / 1000
    Print " "
    Print " "
    Print Distribution (GRAPH, differential, bar chart,
    scale = 0.00)
    For LOOPCOUNT = 1 to 26
    Print " "
    Next
    END OF PROGRAM
```

Papermaking fibers, as used herein, include all known cellulosic fibers or fiber mixes comprising cellulosic fibers. Fibers suitable for making the webs of this invention comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988, to Laamanen et al.; U.S. Pat. No. 4,594,130, issued Jun. 10, 1986, to Chang et al.; and U.S. Pat. No. 3,585,104. Useful fibers can also be produced by anthraquinone pulping, exemplified by U.S. Pat. No. 5,595,628, issued Jan. 21, 1997, to Gordon et al. A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present invention include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

Machine Direction Slope A or Cross-Machine Direction Slope A is a measure of the stiffness of a sheet and is also referred to as elastic modulus. The slope of a sample in the machine direction or the cross-machine direction is a measure of the slope of a stress-strain curve of a sheet taken during a test of tensile testing (see geometric mean tensile strength definition above) and is expressed in units of grams of force. In particular, the slope A is taken as the least squares fit of the data between stress values of 70 grams of force and 157 grams of force. The geometric mean slope A is then the square root of the quantity derived by multiplying the MD slope A times the CD slope A.

Machine Direction Coefficient of Friction and Cross-Machine Direction of Coefficient of Friction is obtained using the Kawabata Evaluation System (KES) test instrument KES model FB-4-S. The KES instrument is available from Kato Tech Co, Ltd. 26 Karato-Cho, Nishikugo, Minami-Ku Kyoto 6701-8447 Japan. The sample is placed on a specimen tray, and a holding frame is placed over the specimen. The machine direction measurement is taken first. Two probes, one to measure the coefficient of friction (reported as MIU) and one to measure the surface roughness (reported as SMD) are placed on the sample. The probe for measurement of surface roughness is made of a steel wire of diameter of 0.5 mm. The coefficient of friction is measured using a probe with 10 pieces of steel wires each 0.5 mm in diameter, and is designed to simulate the human finger. The sample is moved forward and backward underneath the two probes at a constant rate of 0.1 cm/sec. The measurement is taken for 2 cm over the surface. The distance or displacement of the probe is detected by a potentiometer. The coefficient of friction probe is detected by a force transducer. The vertical movements of the surface roughness probe are detected by a transducer. The displacement (distance) of the sample (L, cm) vs. the coefficient of friction (MIU—unitless) and surface roughness (SMD—$\mu$m) are plotted. The sample is then rotated 90 degrees and tested again to provide the cross machine direction measurements. The following settings were used:

Friction sensitivity=2×5

Roughness Sensitivity=2×5

Static Load=25 g

With the above settings, the raw numbers from the instrument are then multiplied by 0.2 to yield the final coefficient of friction results.

Kawabata Bending Stiffness was measured using the KES model FB-2, again available from the Kato Tech Company. To measure bending the sample is clamped in an upright position between two chucks and a 0.4 mm center adjustment plate is used (the size of the adjustment plate is dependent on the sample thickness). One of the chucks is stationary while the other rotates in a curvature between 2.5 $cm^{-1}$ and −2.5 $cm^{-1}$.

The movable chuck moves at a rate of 0.5 $cm^{-1}$/sec. The amount of moment (grams force*cm/cm) taken to bend the material vs. the curvature is plotted. For all the materials tested, the following instrument settings were used:

Measurement mode=one cycle

Sensitivity=2×1

K Span Control=SET

Curvature=+/−2.5 $cm^{-1}$

The KES system algorithm computes the following bending characteristic values:

B=bending stiffness (grams force×$cm^2$/cm)

2HB=bending hysteresis (grams force×cm/cm)

Both MD and CD bending stiffness were tested for each sample, and the mean bending stiffness calculated by taking the arithmetic average of the MD and CD measurements. The mean bending stiffness is referred to herein as "Kawabata bending stiffness".

Stiffness/GM A Slope is the Kawabata bending stiffness divided by the geometric mean (GM) slope A.

Compression Linearity is measured using the Kawabata Evaluation System KES model FB-3, again available from Kato Tech Company.

The instrument is designed to measure the compression properties of materials by compressing the sample between two plungers. To measure the compression properties, the top plunger is brought down on the sample at a constant rate until it reaches the maximum preset force. The displacement of the plunger is detected by a potentiometer. The amount of pressure taken to compress the sample (P, $g_f/cm^2$) vs. thickness (displacement) of the material (T, mm) is plotted on the computer screen. For all the materials in this study, the following instrument settings were used:

Sensitivity=2×5

Gear (speed)=1 mm/50 sec

Fm set=5.0

Stroke select=Max 5 mm

Compression area=2 $cm^2$

Time lag=standard

Max compression force=50 $g_f$

The KES algorithm calculates the following compression characteristic values and displays them on a computer screen:

Compression Linearity (LC).

Compression Energy (WC)

Compression Resilience (RC).

Thickness value measured at the minimum pressure of 0.5 $g_f/cm^2$ (TO)

Thickness value measured at full compression pressure of 50 $g_f/cm^2$ (TM)

The following formula was used to calculate the compression rate (EMC):

$$EMC\ \% = \frac{TO - TM}{TO} \times 100$$

5 measurements were taken on each sample.

The compression linearity values are reported in the Examples.

SUMMARY OF THE INVENTION

The present invention is generally directed to the production of spirally wound paper products, such as tissue products, that have consumer desired roll bulk and firmness values, while maintaining good sheet softness and strength characteristics. The present invention is also directed to a shear-calendering device and to a process for using the device. As described above, tissue products made in accordance with the present invention possess various novel characteristics. In one embodiment, for instance, the present invention is directed to a rolled tissue product made from a single-ply tissue web spirally wound into the roll. The wound roll has a Kershaw roll firmness of less than about 7.8 mm, particularly less than about 7.6 mm and more particularly less than about 7.0 mm. In one embodiment, for instance, the wound roll can have a Kershaw roll firmness of from about 7.0 mm to about 7.8 mm, and particularly from about 7.2 mm to about 7.5 mm.

After being wound, the roll of tissue web has a roll bulk of greater than about 10.0 cc/g, particularly greater than about 11 cc/g, more particularly greater than about 12 cc/g, and more particularly greater than about 13 cc/g. Further, the single ply tissue web can have a fuzz-on-edge on at least one side of the web of greater than about 1.7 mm/mm, particularly greater than about 2.0 mm/mm, and more particularly greater than about 3.0 mm/mm. For instance, in one embodiment, the fuzz-on-edge on at least one side of the tissue web can be greater than about 3.5 mm/mm.

Besides the above softness properties, the tissue web can also maintain a geometric mean tensile strength of greater than about 550 g/3 inches, such as greater than about 600 g/3 inches. For instance, in different embodiments of the present invention, the tissue web can have a geometric mean tensile strength of greater than about 700 g/3 inches, and particularly greater than about 750 g/3 inches.

Base webs made according to the present invention can also have a coefficient of friction in the machine direction or in the cross-machine direction of greater than about 0.32 when tested on the side of the web with the highest fuzz-on-edge value. The bending stiffness/GM slope A of the base webs can be less than about 0.006 and the base webs can have a compression linearity of less than about 0.50.

The basis weight of the single-ply tissue product can vary depending upon the product being produced. For most applications, however, the basis weight is greater than about 30 gsm, such as greater than about 32 gsm. For example, in different embodiments of the present invention, the basis weight can be greater than about 34 gsm, such as greater than about 36 gsm.

In one embodiment, in order to produce tissue products having the above characteristics, the products are fed through a shear-calendering process that incorporates a shear-calendering device. In this embodiment, a tissue web is first formed containing pulp fibers. The tissue web is then conveyed through a nip formed between an outer surface of a rotating roll and an opposing moving surface. The outer surface of the rotating roll and the opposing surface can contact each other or form a gap that has a height that is less than the thickness of the tissue web. The outer surface of the roll and the opposing surface move at different speeds within the nip. In this manner, the nip not only calenders the tissue web, but also simultaneously subjects the web to shearing forces sufficient to increase the fuzz-on-edge properties of the web. Once fed through the shear-calendering device as described above, the web can then be wound under sufficient tension to create a rolled product having desired firmness.

In one embodiment, the shear-calendering device used in the process of the present invention can include two rotating rolls positioned opposite one another. In another embodiment, however, a rotating roll can be positioned opposite a moving belt.

The exterior surfaces of the rotating rolls used in the shear-calendering devices of the present invention can be formed from a metal or from a polymeric material, such as a polyurethane. For example, in one embodiment, a first rotating roll can have a metal surface while the opposing roll can have a compressible surface. Alternatively, both rolls can be made with a compressible surface made from a polymeric material. Likewise, when the shear-calendering device includes a belt, the belt can also be made from a metal or from a polymeric material.

As described above, the two opposing surfaces forming the nip of the shear-calendering device move at different speeds. For example, the two opposing surfaces can move at a speed differential of between about 5% and about 100%, particularly at a speed differential of between about 5% and 40%, and more particularly at a speed differential of between about 15% and about 25%. As used herein, the speed differential is the difference in speed, expressed as percent, between the line speed and the speed of the belt or roll not running at the line speed, divided by the line speed, and expressed as a positive number regardless of which roll or belt is running at the greater speed.

The nip through which the tissue webs are fed can be a closed nip or can include a gap. For example, the nip can have a gap that is from about 2% to about 25% of the thickness of a web being fed through the device. If the gap is closed, the nip is controlled to a nip load force between the two opposing rolls.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the specification, including reference to the accompanying Figures in which.

Figure 1:
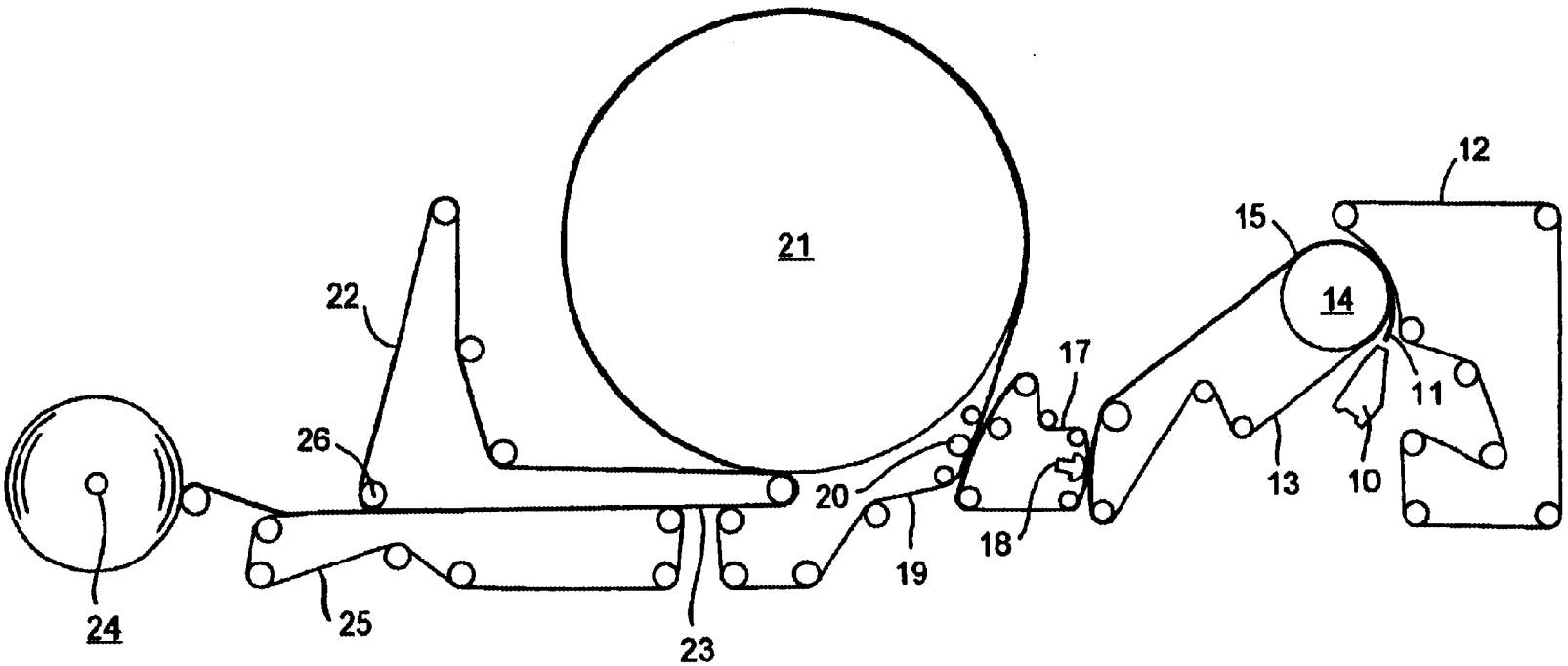
FIG. 1 is a cross-sectional view of one embodiment of a process for making paper webs for use in the present invention.

Repeated use of reference characters in the present specification and drawings is intended to represent the same or analogous features or elements of the present invention.

DETAILED DESCRIPTION OF THE INVENTION

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for producing spirally-wound single-ply tissue products. Through the process of the present invention, the spirally-wound products have a unique combination of properties that represent various improvements over prior art constructions. In particular, single-ply spirally-wound products made according to the present invention have characteristics similar to wound tissue products made from multiply plies. Specifically, wound products made according to the present invention have a consumer-desired amount of roll firmness and bulk, while still maintaining great sheet softness and strength properties.

For example, rolled products made according to the present invention can have a Kershaw roll firmness of less than about 7.8 mm, such as less than about 7.6 mm. In one particular embodiment, for instance, the Kershaw roll firmness can be less than about 7.3 mm, such as less than about 7.0 mm. Within the above-roll firmness ranges, rolls made according to the present invention do not appear to be overly soft and "mushy" as may be undesirable by some consumers during some applications.

In the past, at the above-roll firmness levels, single-ply tissue products had a tendency to have low roll bulks and/or poor sheet softness properties. Single-ply webs made according to the present invention, however, can be produced such that the webs can maintain a roll bulk of at least 10.0 cc/g, such as at least 12 cc/g, even when spirally wound under tension. For instance, spirally wound products made in accordance with the present invention can have a roll bulk of greater than about 13 cc/g, such as greater than about 14 cc/g while still maintaining superior sheet softness.

For example, it has been discovered that the spirally wound base web of the present invention maintains a relatively high amount of fuzz-on-edge properties when wound. As used herein, a fuzz-on-edge test is a test that generally measures the amount of fibers present on the surface of the base web that protrudes from the sheet. The greater the fuzz-on-edge of a base web, the softer the base web feels. In particular, the fuzz-on-edge corresponds to a greater number of fibers on the surface of the web in the z-direction which provides a "fuzzy" soft feel. For example, spirally wound single ply base webs made according to the present invention can have a fuzz-on-edge value of 1.7 mm/mm or greater on at least one side of the web, such as a value of about 2.0 mm/mm or greater. For instance, in one embodiment, the base web can have a fuzz-on-edge value of greater than about 2.5 mm/mm and in still another embodiment, the base web can have a fuzz-on-edge value of greater than 3.0 mm/mm on at least one side of the web.

The basis weight of the single ply tissue products made in accordance with the present invention can vary depending upon the particular application. For example, the basis weight of the products can be greater than about 30 gsm bone dry, such as greater than about 32 gsm bone dry. In one embodiment, for instance, the basis weight of the base web can be greater than about 34 gsm bone dry or greater than about 36 gsm bone dry.

As described above, tissue products made in accordance with the present invention also have relatively high strength values. For example, in combination with the above-described properties, the single ply web can also have a geometric mean tensile strength of about 550 grams per 3 inches or greater, such as greater than about 600 grams per 3 inches. In particular embodiments, the strength of the tissue web can be greater than about 700 grams per 3 inches or greater than about 750 grams per 3 inches.

Base webs that may be used in the process of the present invention can vary depending upon the particular application. In general, any suitably made base web may be used in the process of the present invention. Further, the webs can be made from any suitable type of fiber. For instance, the base web can be made from pulp fibers, other natural fibers, synthetic fibers, and the like.

Papermaking fibers useful for purposes of this invention include any cellulosic fibers which are known to be useful for making paper, particularly those fibers useful for making relatively low density papers such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers. As used herein, secondary fibers means any cellulosic fiber which has previously been isolated from its original matrix via physical, chemical or mechanical means and, further, has been formed into a fiber web, dried to a moisture content of about 10 weight percent or less and subsequently reisolated from its web matrix by some physical, chemical or mechanical means.

Paper webs made in accordance with the present invention can be made with a homogeneous fiber furnish or can be formed from a stratified fiber furnish producing layers within the single ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers. The hardwood fibers can be mixed, if desired, with paper broke in an amount up to about 10% by weight and/or softwood fibers in an amount up to about 10% by weight. The base web further includes a middle layer positioned in between the first outer layer and the second outer layer. The middle layer can contain primarily softwood fibers. If desired other fibers, such as high-yield fibers or synthetic fibers may be mixed with the softwood fibers in an amount up to about 10% by weight.

When constructing a web from a stratified fiber furnish, the relative weight of each layer can vary depending upon the particular application. For example, in one embodiment, when constructing a web containing three layers, each layer can be from about 15% to about 40% of the total weight of the web, such as from about 25% to about 35% of the weight of the web.

As described above, the tissue product of the present invention can generally be formed by any of a variety of papermaking processes known in the art. In fact, any process capable of forming a paper web can be utilized in the present invention. For example, a papermaking process of the present invention can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. No. 5,048,589 to Cook, et al.; U.S. Pat. No. 5,399,412 to Sudall et al.; U.S. Pat. No. 5,129,988 to Farrington, Jr.; and U.S. Pat. No. 5,494,554 to Edwards et al.; which are incorporated herein in their entirety by reference thereto for all purposes.

For example, the web can contain pulp fibers and can be formed in a wet-lay process according to conventional paper making techniques. In a wet-lay process, the fiber furnish is combined with water to form an aqueous suspension. The aqueous suspension is spread onto a wire or felt and dried to form the web.

In one embodiment, the base web is formed by an uncreped through-air drying process. Referring to FIG. 1, a schematic process flow diagram illustrating a method of making uncreped throughdried sheets in accordance with this embodiment is illustrated. Shown is a twin wire former having a papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent. Specifically, the suspension of fibers is deposited on the forming fabric 13 between a forming roll 14 and another dewatering fabric 12. Additional dewatering of the wet web can be carried out, such as by vacuum suction, while the wet web is supported by the forming fabric.

The wet web is then transferred from the forming fabric to a transfer fabric 17 traveling at a slower speed than the forming fabric in order to impart increased stretch into the web. Transfer is preferably carried out with the assistance of a vacuum shoe 18 and a kiss transfer to avoid compression of the wet web.

The web is then transferred from the transfer fabric to the throughdrying fabric 19 with the aid of a vacuum transfer roll 20 or a vacuum transfer shoe. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance.

The level of vacuum used for the web transfers can be, for instance, from about 3 to about 15 inches of mercury (75 to about 380 millimeters of mercury), such as about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern.

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di (hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

In manufacturing the tissues of this invention, it is preferable to include a transfer fabric to improve the smoothness of the sheet and/or impart sufficient stretch. As used herein, "transfer fabric" is a fabric which is positioned between the forming section and the drying section of the web manufacturing process. The fabric can have a relatively smooth surface contour to impart smoothness to the web, yet must have enough texture to grab the web and maintain contact during a rush transfer. It is preferred that the transfer of the web from the forming fabric to the transfer fabric be carried out with a "fixed-gap" transfer or a "kiss" transfer in which the web is not substantially compressed between the two fabrics in order to preserve the caliper or bulk of the tissue and/or minimize fabric wear.

In order to provide stretch to the tissue, a speed differential is provided between fabrics at one or more points of transfer of the wet web. This process is known as rush transfer. The speed difference between the forming fabric and the transfer fabric can be from about 5 to about 75 percent or greater, such as from about 10 to about 35 percent. For instance, in one embodiment, the speed difference can be from about 15 to about 25 percent, based on the speed of the slower transfer fabric. The optimum speed differential will depend on a variety of factors, including the particular type of product being made. As previously mentioned, the increase in stretch imparted to the web is proportional to the speed differential. For a single-ply uncreped throughdried bath tissue having a basis weight of about 30 grams per square meter, for example, a speed differential of from about 20 to about 30 percent between the forming fabric and a transfer fabric produces a stretch in the final product of from about 15 to about 25 percent. The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The web is transferred to the throughdrying fabric for final drying preferably with the assistance of vacuum to ensure macroscopic rearrangement of the web to give the desired bulk and appearance. The use of separate transfer and throughdrying fabrics can offer various advantages since it allows the two fabrics to be designed specifically to address key product requirements independently. For example, the transfer fabrics are generally optimized to allow efficient conversion of high rush transfer levels to high MD stretch while throughdrying fabrics are designed to deliver bulk and CD stretch. It is therefore useful to have moderately coarse and moderately three-dimensional transfer fabrics and throughdrying fabrics which are quite coarse and three dimensional in the optimized configuration. The result is that a relatively smooth sheet leaves the transfer section and then is macroscopically rearranged (with vacuum assist) to give the high bulk, high CD stretch surface topology of the throughdrying fabric. Sheet topology is completely changed from transfer to throughdrying fabric and fibers are macroscopically rearranged, including significant fiber-fiber movement.

The drying process can be any noncompressive drying method which tends to preserve the bulk or thickness of the wet web including, without limitation, throughdrying, infrared radiation, microwave drying, etc. Because of its commercial availability and practicality, throughdrying is well known and is one commonly used means for noncompressively drying the web for purposes of this invention. Suitable throughdrying fabrics include, without limitation, Asten 920A and 937A and Velostar P800 and 103A. Additional suitable throughdrying fabrics include fabrics having a sculpture layer and a load-bearing layer such as those disclosed in U.S. Pat. No. 5,429,686, incorporated herein by reference to the extent it is not contradictory herewith. The web is preferably dried to final dryness on the throughdrying fabric, without being pressed against the surface of a Yankee dryer, and without subsequent creping.

After the web is formed and dried, the tissue product of the present invention undergoes a converting process where the formed base web is wound into a roll for final packaging. Prior to or during this converting process, in accordance with the present invention, the base web of the tissue product is subjected to a shear-calendering process in order to generate a high value of fuzziness (fuzz-on-edge value) while maintaining sufficient tensile strength. This shear-calendering process compresses and shears the web at the same time, effectively breaking some bonds formed between the fibers of the base web. The fuzz-on-edge characteristic of the base web and thus the perceived softness of the tissue product is increased without significantly sacrificing tensile strength or any other characteristic of the tissue product. In some applications, the bulk of the tissue web can be largely maintained. At the very least, through this process, a greater amount of bulk remains in the sheet after the sheet is wound than in traditional calendering. This higher sheet bulk is manifested as higher product roll bulk at a fixed firmness while maintaining the required sheet softness.

Two examples of shear calendering devices for use in the present invention are roll-gap calendering and roll-belt shearing. Both of these examples are described in further detail below. However, this invention is not limited to these two types of shear calendering processes or devices and is intended to include other methods prior to or during the conversion step that increases the softness of the tissue product.

Figure 2:
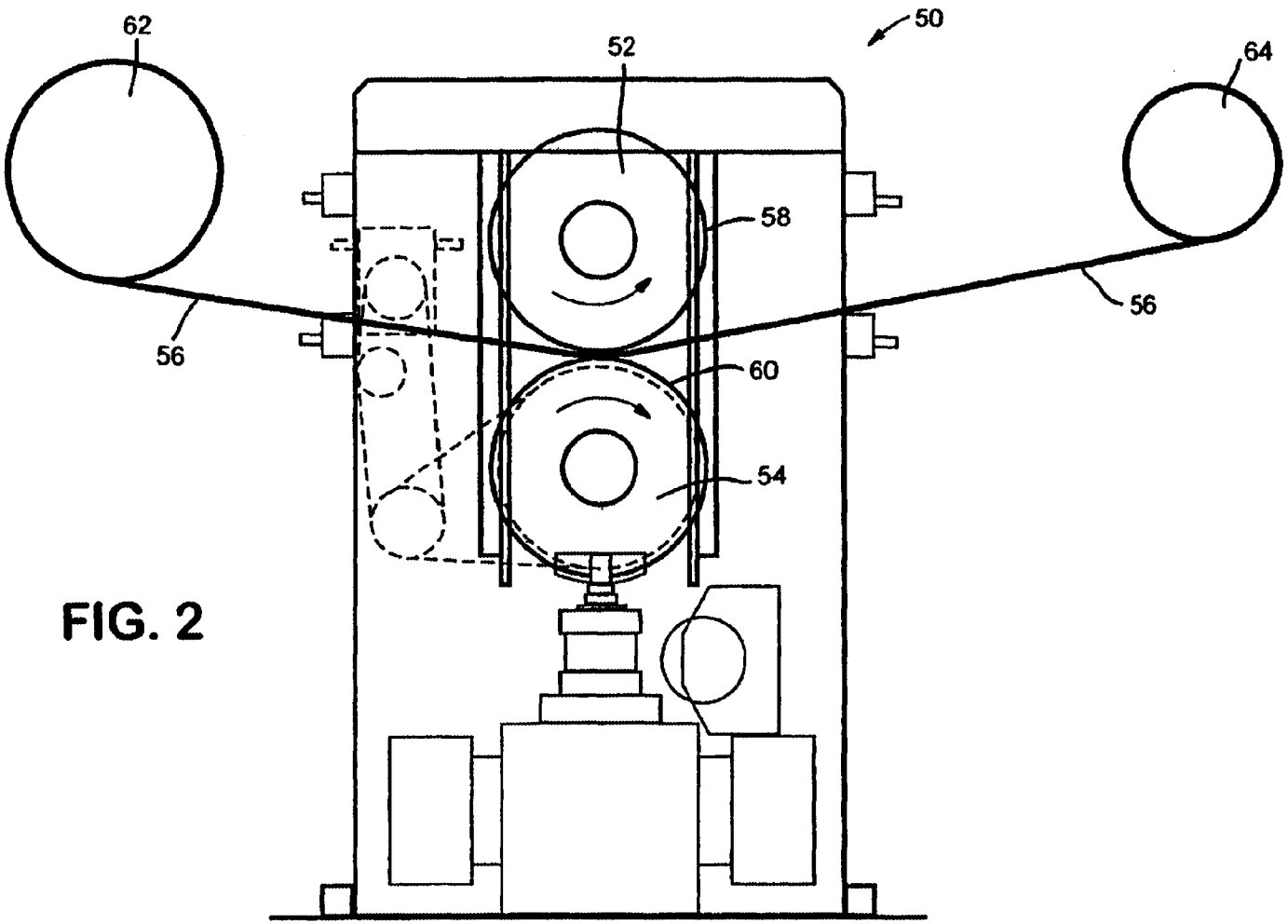
FIG. 2 is a side view of one embodiment of a shear-calendering device of the present invention.

Roll-gap calendering causes in-plane shear to be imparted to the base web at relatively low compression levels in a calender nip in order to achieve higher fuzziness and higher calipers than conventional calendering, thus resulting in higher bulk. Referring to FIG. 2, one embodiment of a roll-gap apparatus 50 is illustrated. In general, roll-gap calendering involves two calendering rolls 52 and 54 that compress and shear the base web 56. The surfaces 58 and 60 of calendering rolls 52 and 54 contacting base web 56 can comprise many materials, including paper, a fabric, metals such as steel or cast iron, or polymeric materials such as polyurethane, natural rubber (hard or soft), synthetic rubbers, elastomeric materials, and the like. Furthermore, the roll surfaces can be smooth, roughened, or etched. In one embodiment, both calendering rolls 52 and 54 have a surface 58 and 60 comprising a polymer material. In an alternative embodiment, one of the calendering rolls has a surface that is steel, while the other surface comprises a polymer material.

The calendering is achieved through compression of base web 56. The two calendering rolls 52 and 54 form a gap in the nip that ranges between about 2% and about 25% of the thickness of the base web. However, shear calendering may be achieved without the use of a gap between the two calendering rolls. Instead, the surfaces of the two rolls can be pressed together to form a pressure between the surfaces that compresses the base web at a higher pressure than the gap. However, depending on the load settings and the z-direction properties of the web, it is possible to run the nipped mode at the same or even less pressure than the gap mode.

Both calendering rolls 52 and 54 rotate so their respective surfaces 58 and 60 move in the same direction as base web 56. For instance, in the embodiment shown in FIG. 2, base web 56 moves from an unwind roll 62 through roll-gap calendering apparatus 50 and is rewound onto a roll 64. Thus, in this embodiment, calendering roll 52 is rotating counter-clockwise, and calendering roll 54 is rotating clockwise.

A higher degree of shearing is achieved by creating a greater speed differential between contacting surfaces 58 and 60 of calendar rolls 52 and 54, respectfully. The speed differential between the surfaces contacting the web can be obtained by any means. For example, the rolls can have the same diameter and rotate at different speeds. Alternatively, the rolls can have different diameters and can be rotating at the same rotational speed, thus the surface speeds of the rolls are different because of the difference in the roll diameters.

Either surface 58 or 60 of calendering rolls 52 and 54 can move faster than the other. One of the surfaces is moving at the same speed as the web and thus is said to be gripping or carrying the web. Depending on which roll is carrying the base web, the other roll, which is moving at a different speed, generates the shearing force on the web. The carrying surface moves with base web 56 at the same speed, and the other surface moves between about 5% and about 100% either faster or slower than the carrying surface. The particular embodiment in FIG. 2 shows that calendering roll 52 is carrying the base web. Thus, in this embodiment, surface 58 of roll 52 is moving at the same speed as the base web 56, and surface 60 of roll 54 is moving faster or slower than base web 56 at a speed differential as described. Desirably, the speed of the web matches the speed of the carrying or gripping roll. Wrapping or contacting the carrying roll with the web at the point of shear will help avoid slippage of the web as it is sheared by the shearing roll. Preferably the wrap angle upon exit of the nip is between 10 and 45 degrees.

The speed differential between surfaces 58 and 60 can be between about 5% and about 100%. When both surfaces 58 and 60 comprise an elastomer, the speed differential between the two calendering rolls can be between about 7% and about 40%, such as between about 7% and about 15%. Alternatively, when surface 58 comprises an elastomer and surface 60 comprises steel, the speed differential between surfaces can be between 7% and about 40%, such as between about 15% and about 25%.

The side of base web 56 that contacts the faster or slower moving shear calendering surface is commonly referred to as the fabric side of the web, and the side of base web 56 that contacts the carrying surface is commonly referred to as the air side of the web. Thus, in the embodiment shown in FIG. 2, the upper side of base web 56 is the air side, and the lower side is the fabric side. To achieve more desirable fuzz-on-edge characteristics on either side of the web, base web 56 can optionally undergo a shear calendering process directed at shearing a targeted side of the web. For example, the side of the web targeted for shearing would have the opposing side contacting the carrying roll surface.

For uncreped, through-air dried base webs, the fabric side (the side of the web contacting the dryer fabric) is generally softer than the air side, even before treatment by the shearing process. The shearing process, as described above, tends to make the fabric side even softer, while the air side remains relatively unchanged. For this reason, the fuzz-on-edge values, as reported herein, are for the softer side of the web, which in this case is the fabric side.

In the wound product, it is often advantageous to wind the product with the softest side facing the consumer, and hence the shearing process to increase the softness of this side is preferred. However, it is also possible to treat the air side of the web rather than the fabric side, and in these embodiments, it would be possible to increase the air-side softness to a level higher than that of the fabric side.

Roll-belt shearing is another type of a shearing process. Roll-belt shearing works the surface of the base web through aggressive shearing and has the capability of caliper, and thus bulk, control though adjusting the belt tension as well as the belt type. The in-plane shear is achieved by a speed differential between a belt and a roll. The belt tension generates pressure on the sheet that can serve to calender the base web, as well as shear the base web.

Figure 3:
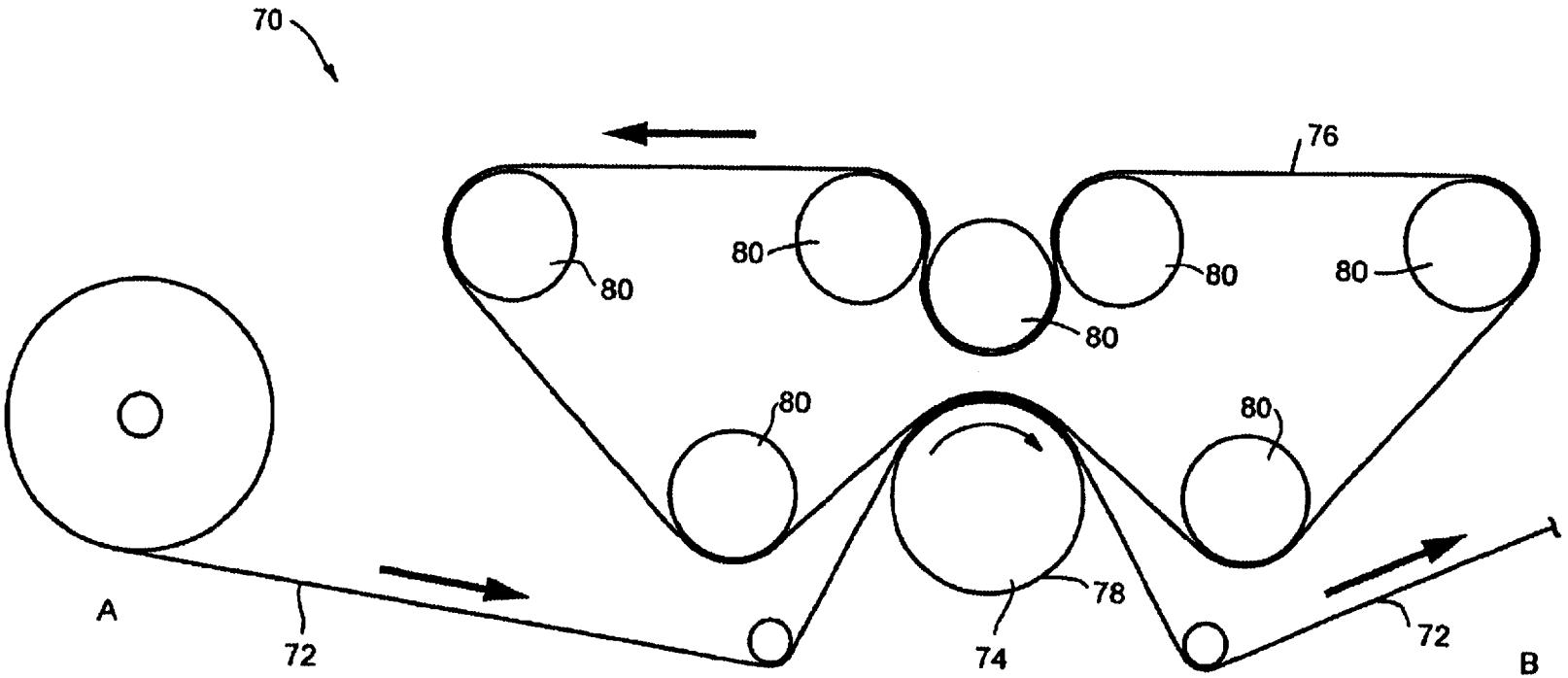
FIG. 3 is a side view of another embodiment of a shear-calendering device made in accordance with the present invention.
Figure 4:
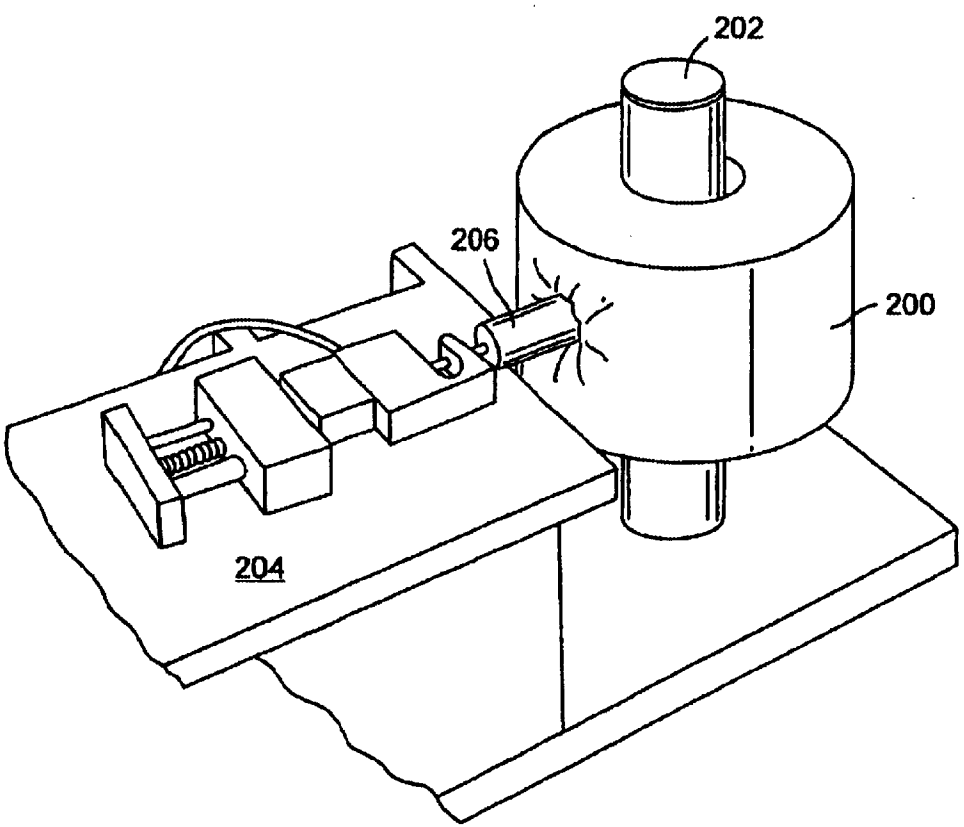
FIG. 4 is a perspective view of an apparatus for determining roll firmness.
Figure 5:
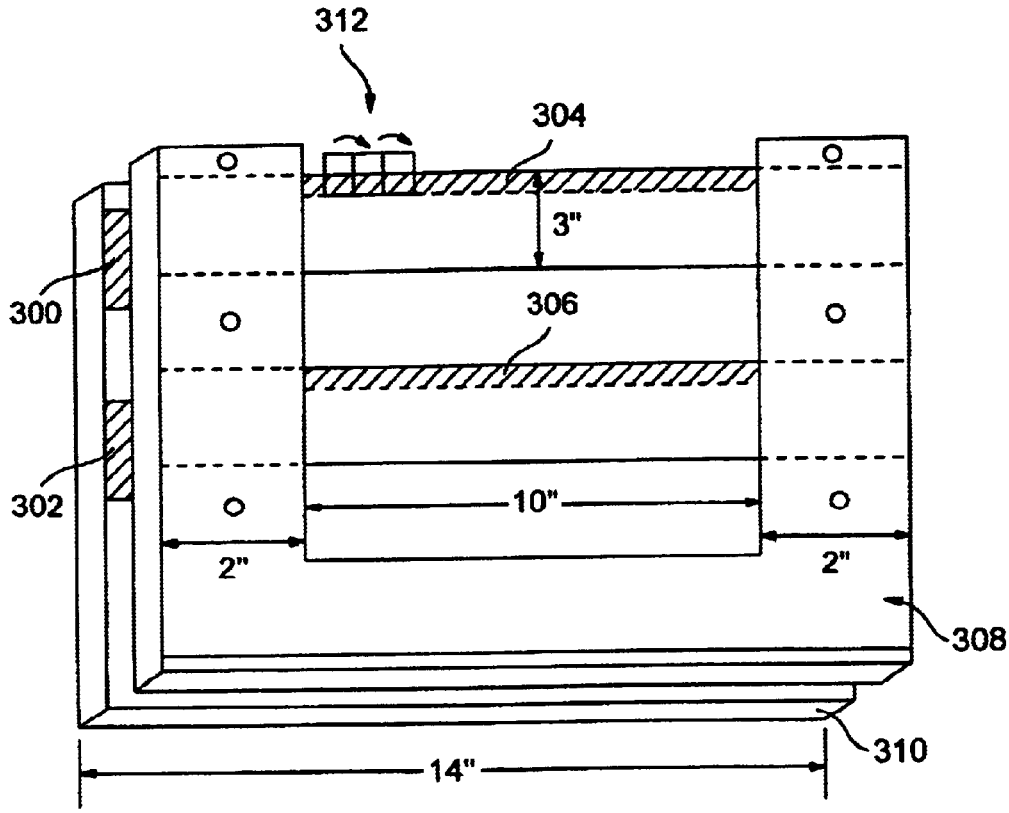
FIG. 5 is a perspective view of a fixture used to conduct a fuzz-on-edge test as described herein.
Figure 6:
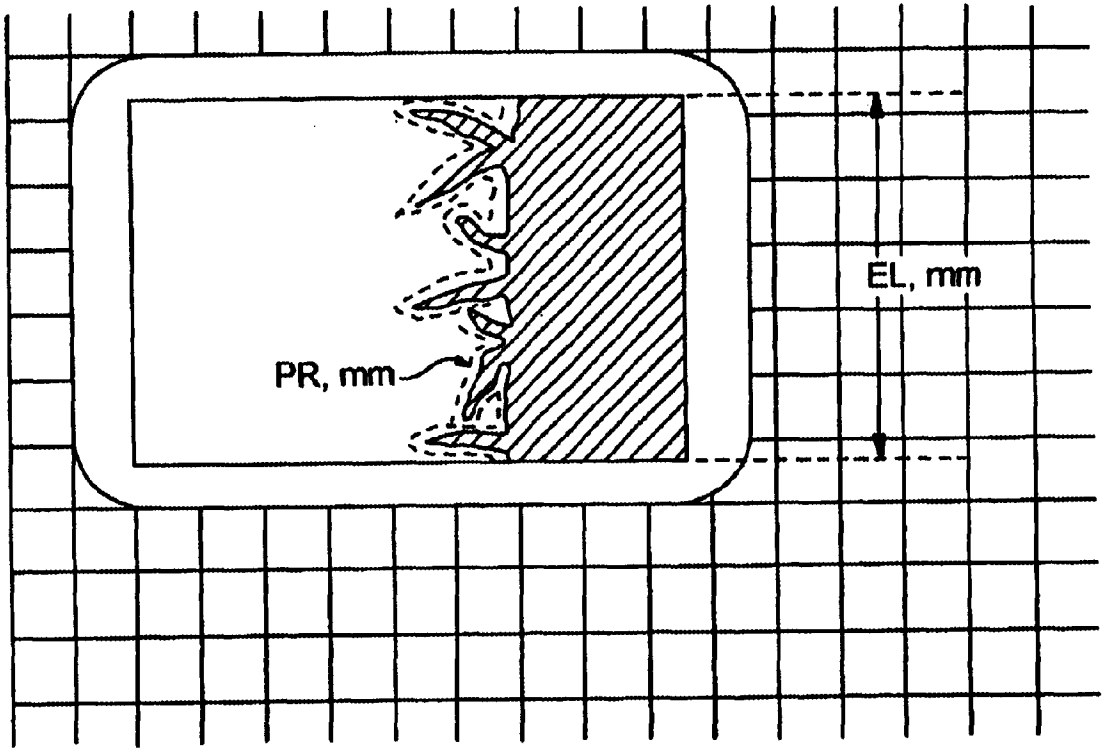
FIG. 6 is a diagrammatical view showing the measurements taking during the fuzz-on-edge test.

Referring generally to one embodiment of a roll-belt apparatus 70 shown in FIG. 3, the roll-belt shearing process is generally described. In general, base web 72 is compressed and sheared by roll 74 and belt 76. Both the surface 78 of roll 74 and the belt 76 move in the same direction as base web 72. Thus, in the embodiment depicted in FIG. 3, the base web is traveling from A to B (in a left to right direction); therefore, roll 74 is rotating clockwise, and belt 76 is rotating around rollers 80 in a counterclockwise direction.

Belt 76 can be made from many various materials; for instance, the belt can be a woven or nonwoven fabric, a rubber belt, a cloth-like belt such as a felt, a metal wire belt, or the like. Also, the surface of belt 76 can be smooth, textured, roughened, or etched. Likewise, roll 74 can comprise many materials, including metals such as steel, metals coated with substances, such as tungsten carbide coated on steel, or a polymer material, such as polyurethane, natural rubber (soft or hard), synthetic rubber, elastomeric materials, and the like. Also, the surface of the roll can be smooth, roughened, or etched.

Belt 76 has a tension around rollers 80. The tension of belt 76 can be measured by a Huyck tensiometer and reported in Huyck units, which is well known within the art. For the purposes of roll-belt shearing, the tension of belt 76 can be between about 45 Huyck and about 95 Huyck, such as between about 50 Huyck and about 80 Huyck. For instance, in one embodiment, the tension can be between about 60 Huyck and about 70 Huyck. The number and placement of rollers 80 can be any configuration that allows the roll-belt shearing apparatus to function accordingly.

In the nip between the roll 74 and belt 76, there can be a gap of about 0.0–0.005 inches or the roll and the belt can press together. The gap distance, however, depends on the web being sheared. Also, either roll 74 or belt 76 can be moving faster than the other. The speed differential between roll 74 and belt 76 can be between about 5% and about 100%, such as between about 7% and about 50%. For instance, in one embodiment, the speed differential is between about 10% and about 20%. However, depending on the amount of friction in the nip, the speed differential can be varied to achieve desired results.

Depending on the coefficient of friction between belt 76 or roll 74 and base web 72 and the degree to which the web is held by the belt, either roll 74 or the belt 76 can move faster than the other. Depending on which side grips the sheet, the shear will primarily fuzz up the opposite side of the sheet. The shearing side can be moving faster or slower than the gripping side. Thus, there are four different possible embodiments of roll-belt shearing: 1) roll grips sheet, roll goes faster, 2) roll grips sheet, belt goes faster, 3) belt grips sheet, roll goes faster and 4) belt grips sheet, belt goes faster. Desirably, the speed of the web matches the speed of the carrying or gripping surface. Extending the contact between the web and the carrying surface after the nip will avoid slippage of the web as it is sheared by the shearing roll or belt. Preferably the wrap angle upon exit of the nip is between 10 and 45 degrees.

After being subjected to the roll-belt shearing apparatus 70 as shown in FIG. 3, the base web can be rewound under sufficient tension to produce a roll having desired firmness levels. Prior to being rewound, the base web can also be subjected to various other finishing processes as desired.

For most applications, after the base web is contacted with a shear-calendering device, such as a roll-gap shearing device or a roll-belt shearing device as shown in FIGS. 2 and 3, the base web is wound into a roll having a Kershaw firmness of less than about 7.8 mm, particularly less than about 7.6 mm, and more particularly less than about 7.3 mm. For example, in one embodiment, the Kershaw firmness can be less than 7.0 mm. The present inventors have discovered that, even at the above firmness levels, wound products produced using a shear-calendering device as described above still maintain excellent softness levels. In particular, base webs made according to the present invention can have a fuzz-on-edge of greater than about 1.7 mm/mm, particularly greater than about 2.0 mm/mm, and more particularly greater than about 2.5 mm/mm. For example, in one embodiment, the fuzz-on-edge of a base web made according to the present invention can be greater than about 3.0 mm/mm, such as greater than 3.5 mm/mm. These fuzz-on-edge values can be present on the base web after the web has been wound into a final roll for packaging.

In addition to increased fuzz-on-edge values, it is believed that the shear-calendering device of the present invention can preserve the bulk of the web even after being wound. For instance, rolled products made according to the present invention can have a roll bulk of greater than about 11.5 cc/g, particularly greater than about 12 cc/g, and more particularly greater than about 13 cc/g. In one embodiment, for instance, it is believed that rolls can be formed having a bulk greater than about 14 cc/g while achieving good sheet softness and high roll firmness.

Rolled products made according to the present invention can exhibit the above properties at various basis weights and strength values. For example, the single ply base web can have a basis weight of greater than about 30 gsm bone dry, particularly greater than about 32 gsm bone dry, and more particularly greater than about 34 gsm bone dry. In general, the basis weight will vary depending upon the particular product being produced. For example, bath tissues generally have a much lower basis weight than paper towels. One-ply bath tissues, for instance, can have a basis weight of from about 30 gsm bone dry to about 45 gsm bone dry and 1-ply paper towels can have a basis weight of from about 32 to about 70 gsm bone dry.

The geometric mean tensile strength of base webs formed according to the present invention can be greater than about 600 grams per 3 inches, particularly greater than about 650 grams per 3 inches, and more particularly greater than about 700 grams per 3 inches.

The geometric mean tensile strength will vary depending upon the basis weight of the web, the manner in which the web is produced, and the fiber furnish used to form the web. For example, in some embodiments, the geometric mean tensile strength of the web can be greater than 750 grams per 3 inches.

The following examples are intended to illustrate particular embodiments of the present invention without limiting the scope of the appended claims.

EXAMPLES

Example 1

An uncreped through-dried bath tissue was produced by the methods described in U.S. Pat. No. 5,932,068, using a t1203-8 through-drying fabric and a t-807-1 transfer fabric, both supplied by Voith Fabrics Inc. The base web was made of 34% Northern Softwood Kraft (NSWK) and 66% Kraft eucalyptus, which was layered as follows: 33% eucalyptus/34% NSWK/33% eucalyptus by weight.

The eucalyptus was treated with 4.1 kg/mt active debonder and the NSWK was refined between 0 and 2.5 HPD/T with 2–3 kg/mt of PAREZ wet strength resin added. Three samples of varying tensile strength were produced by varying the refining and PAREZ wet strength addition.

The tissue was vacuum dewatered to approximately 26–28% consistency prior to entering two through-dryers and then dried in the through-dryers to approximately 1% final moisture prior to winding of the parent rolls.

A portion of the tissue was then converted using standard techniques, specifically using a single conventional polyurethane/steel calender. The calender contained a 40 P&J polyurethane roll on the air side of the sheet and a standard steel roll on the fabric side. The calender was operated in a standard fixed-load mode to produce control tissue rolls. The finished product diameter was fixed at 118 mm, and the calendering set to produce a Kershaw roll firmness of 7.5 mm with a 210 sheet count and 104 mm sheet length. The roll weight of the resulting product was targeted for approximately 78 grams, yielding roll bulks of approximately 11.8 cc/gram.

Three samples differing only in tensile strength were converted. Initial tensile strengths were 914, 1052 and 1311 grams/3 inches geometric mean tensile, respectively. After converting, sample basesheets were tested for physical properties with the results shown in Table 1. Samples with final geometric mean tensile strengths of 706, 843 and 1019 grams/3 inches had resulting fuzz-on-edge values of 1.6, 1.5, and 1.3 mm/mm on the softer, fabric side of the sheet. Hence these tissue rolls met some desired roll parameters (high bulk and firm roll) but the sheets that made up the rolls were not particularly soft.

Next a sample of the tissue with 1311 grams/3" geometric mean tensile strength was converted using a single roll-gap calender. The calender nip consisted of a 40 P&J polyurethane roll on the air side and a 40 P&J polyurethane roll on the fabric side run in fixed-gap mode. The lower roll was run at a speed 10% greater than the upper polyurethane roll which was running at the overall line speed of 600 fpm. This tissue was also converted into 210 sheet count bathroom tissue roll with a target firmness of 7.5 mm. The resulting roll weight was 76.4 grams and hence a roll bulk of 12.0 cc/gram was obtained. This tissue had a final tensile strength of 757 grams GMT and a fuzz-on-edge of 3.5 mm/mm on the fabric side of the sheet.

This product represents the invention in that the roll bulk is high (12 cc/gram), the roll is firm (7.6 mm firmness) and the 1-ply sheets comprising the roll are both strong (GMT 757 g/3 inches) and soft (FOE 3.5 mm/mm). The properties of the roll of the invention as well as the control samples are shown in Table 1 below.

| Sample | Control 1 | Control 2 | Control 3 | Example 1 |
|---|---|---|---|---|
| Roll Firmness (mm) | 7.8 | 7.5 | 7.8 | 7.6 |
| Bone Dry Roll Weight (grams) | 78.9 | 77.5 | 78.5 | 76.3 |
| Sheet Bone dry | 36.7 | 36.5 | 36.7 | 35.8 |

-continued

| Sample | Control 1 | Control 2 | Control 3 | Example 1 |
|---|---|---|---|---|
| BW (g/m2) | | | | |
| Roll Bulk (cc/g) | 11.7 | 11.9 | 11.7 | 12.0 |
| Sheet Geometric mean Tensile Strength, (Grams/3 inches) | 706 | 843 | 1019 | 757 |
| Fuzz-on-Edge (mm/mm) | 1.6 | 1.5 | 1.3 | 3.5 |
| MD coefficient of friction | 0.32 | NM | NM | 0.33 |
| CD coefficient of friction | 0.31 | NM | NM | 0.32 |
| MD Slope A (kg) | 6.46 | NM | NM | 5.38 |
| CD Slope A (kg) | 8.52 | NM | NM | 9.81 |
| Kawabata bending stiffness | .068 | NM | NM | .043 |
| Stiffness/GM slope A | .00917 | NM | NM | .00592 |
| Compression Linearity | .524 | NM | NM | .472 |

NM = Not measured

Example 2

The base tissue from Example 1 above was also converted using roll-belt shearing to produce a bathroom tissue roll. This was achieved with a 2054 fabric (supplied by Voith Fabrics, Inc.), a 15% speed differential between the roll and the fabric with the roll traveling faster than the fabric, and a 65 huyck fabric tension. In the process, the fabric side of the sheet contacted the fabric, and the air side of the sheet contacted the roll.

The product was again converted to meet a finished roll product specification of a 116 mm diameter, a target roll weight of 76 g, a sheet count of 210 sheets, a Kershaw firmness of 7.5 mm and a sheet length of 104 mm. As the required roll weight was 75.8 grams, the resulting roll bulk was 12.2 cc/g. In this case the finished sheet geometric mean tensile strength was 644 grams and the fuzz-on-edge value was 1.93 mm/mm roll on the fabric side of the sheet. This product is designated Example 2 in the table below, where it is again compared to the control products from Table 1.

| Sample | Control 1 | Control 2 | Control 3 | Example 2 |
|---|---|---|---|---|
| Roll Firmness (mm) | 7.8 | 7.5 | 7.8 | 7.5 |
| Bone Dry Roll Weight (grams) | 78.9 | 77.5 | 78.5 | 75.8 |
| Sheet Bone dry BW (g/m2) | 36.7 | 36.5 | 36.7 | 35.7 |
| Roll Bulk (cc/g) | 11.7 | 11.9 | 11.7 | 12.2 |
| Sheet Geometric Mean Tensile Strength (Grams/3 inches) | 706 | 843 | 1019 | 644 |
| Fuzz-on-Edge (mm/mm) | 1.6 | 1.5 | 1.3 | 1.9 |

Example 3

Finally, the products of this invention are compared to current commercial products in the table below. As is clear from the table, neither of the commercial 1-ply bath tissue products has the properties of the sample in the invention.

The first control sample is also included to facilitate comparison with the conventional calendering technique.

| Sample | Example 1 | Charmin ® Regular Roll | Kleenex Cottonelle ® Regular Roll | Control 1 (regular calendering) |
|---|---|---|---|---|
| Roll firmness, mm | 7.6 | 7.1 | 7.9 | 7.8 |
| Bone Dry Roll Weight (grams) | 76.3 | NM | NM | 78.9 |
| Sheet Bone dry BW (g/m2) | 35.8 | 32.6 | 30.5 | 36.7 |
| Roll Bulk (cc/g) | 12 | 10.7 | 12.5 | 12.1 |
| Sheet Geometric Mean Tensile Strength (Grams/3 inches) | 757 | 619 | 656 | 706 |
| Fuzz-on-Edge (mm/mm) | 3.49 | 1.33 | 1.33 | 1.56 |
| MD coefficient of friction | 0.33 | 0.293 | 0.296 | 0.32 |
| CD coefficient of friction | 0.32 | 0.314 | 0.285 | 0.31 |
| MD Slope A (kg) | 5.38 | 2.71 | 4.98 | 6.46 |
| CD Slope A (kg) | 9.81 | 6.01 | 4.36 | 8.52 |
| Kawabata bending stiffness | 0.043 | 0.025 | 0.032 | 0.068 |
| Stiffness/GM slope A | 0.00592 | 0.00619 | 0.00687 | 0.00917 |
| Compression Linearity | 0.472 | 0.598 | 0.52 | 0.524 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A rolled tissue product comprising:

a single-ply tissue web spirally wound into a roll, the wound roll having a Kershaw roll firmness of less than about 7.8 mm and a roll bulk of greater than about 10 cc/g, the tissue web having a basis weight of greater than about 30 gsm bone dry, the tissue web further having a fuzz-on-edge of greater than about 1.7 mm/mm on at least one side of the web and a geometric mean tensile strength of greater than about 550 g/3 inches.

2. A tissue product as defined in claim 1, wherein the base web comprises an uncreped through-air dried web.

3. A tissue product as defined in claim 1, wherein the roll bulk is about 10.5 cc/g or greater.

4. A tissue product as defined in claim 1, wherein the roll bulk is about 11 cc/g or greater.

5. A tissue product as defined in claim 1, wherein the roll bulk is about 11.5 cc/g or greater.

6. A tissue product as defined in claim 1, wherein the roll bulk is about 12 cc/g or greater.

7. A tissue product as defined in claim 1, wherein the roll bulk is about 13 cc/g or greater.

8. A tissue product as defined in claim 1, wherein the roll bulk is about 14 cc/g or greater.

9. A tissue product as defined in claim 1, wherein the Kershaw firmness is less than about 7.6 mm.

10. A tissue product as defined in claim 1, wherein the Kershaw firmness is less than about 7.3 mm.

11. A tissue product as defined in claim 1, wherein the Kershaw firmness is from about 7.0 to about 7.8 mm.

12. A tissue product as defined in claim 1, wherein the Kershaw firmness is from about 7.2 to about 7.5 mm.

13. A tissue product as defined in claim 1, wherein the basis weight of the tissue web is about 32 gsm bone dry or greater.

14. A tissue product as defined in claim 1, wherein the basis weight of the tissue web is about 34 gsm bone dry or greater.

15. A tissue product as defined in claim 1, wherein the basis weight of the tissue web is about 36 gsm bone dry or greater.

16. A tissue product as defined in claim 1, wherein the basis weight of the tissue web is from about 30 gsm to about 38 gsm bone dry.

17. A tissue product as defined in claim 1, wherein the basis weight of the tissue web is from about 32 gsm to about 36 gsm bone dry.

18. A tissue product as defined in claim 1, wherein the geometric mean tensile strength of the tissue web is about 550 g/3 inches or greater.

19. A tissue product as defined in claim 1, wherein the geometric mean tensile strength of the tissue web is about 600 g/3 inches or greater.

20. A tissue product as defined in claim 1, wherein the geometric mean tensile strength of the tissue web is about 650 g/3 inches or greater.

21. A tissue product as defined in claim 1, wherein the fuzz-on-edge of at least one side of the tissue web is about 2.0 mm/mm or greater.

22. A tissue product as defined in claim 1, wherein the fuzz-on-edge of at least one side of the tissue web is about 2.5 mm/mm or greater.

23. A tissue product as defined in claim 1, wherein the fuzz-on-edge of at least one side of the tissue web is about 3.0 mm/mm or greater.

24. A tissue product as defined in claim 1, wherein the fuzz-on-edge of at least one side of the tissue web is about 3.5 mm/mm or greater.

25. A tissue product as defined in claim 1, wherein the machine direction coefficient of friction of the higher fuzz-on-edge side of the tissue web is greater than about 0.32.

26. A tissue product as defined in claim 1, wherein the cross-machine direction coefficient of friction of higher fuzz-on-edge side of the tissue web is greater than about 0.32.

27. A tissue product as defined in claim 1, wherein the tissue web has a bending stiffness/GM slope A that is less than about 0.006.

28. A tissue product as defined in claim 1, wherein the tissue web has a compression linearity of less than about 0.50.

29. A rolled tissue product comprising:

a single-ply tissue web spirally wound into a roll, the wound roll having a Kershaw roll firmness of less than about 78 mm and a roll bulk of greater than about 13 cc/g, the tissue web having a basis weight of greater than about 30 gsm bone dry, the tissue web having a fuzz-on-edge of greater than about 1.3 mm/mm on at least one side of the web and a geometric mean tensile strength of greater than about, 550 g/3 inches.

30. A rolled tissue product as defined in claim 29, wherein the wound roll has a roll bulk of greater than about 14 cc/g.

31. A rolled tissue product as defined in claim 29, wherein the tissue web has a fuzz-on-edge of greater than about 2 mm/mm on at least one side of the web.

32. A rolled tissue product as defined in claim 29, wherein the tissue web has a fuzz-on-edge of greater than about 3 mm/mm on at least one side of the web.

33. A rolled tissue product as defined in claim 29, wherein the tissue web has a basis weight of from about 30 gsm to about 38 gsm.

34. A rolled tissue product as defined in claim 29, wherein the wound roll has a Kershaw roll firmness of from about 7.0 to about 7.8.

35. A rolled tissue product as defined in claim 29, wherein the wound roll has a Kershaw roll firmness of from about 7.2 to about 7.5.

* * * * *

UNITED STATES PATENT AND TRADEMARK OFFICE

CERTIFICATE OF CORRECTION

PATENT NO. : 6,887,348 B2
DATED : May 3, 2005
INVENTOR(S) : Michael Alan Hermans et al.

It is certified that error appears in the above-identified patent and that said Letters Patent is hereby corrected as shown below:

Column 22,
Line 19, "78 mm" should read -- 7.8 mm --.
Line 24, "about, 550 g/3 inches." should read -- about 550 g/3 inches. --.

Signed and Sealed this

Second Day of May, 2006

JON W. DUDAS
*Director of the United States Patent and Trademark Office*